US007401563B2

(12) United States Patent
Sho

(10) Patent No.: US 7,401,563 B2
(45) Date of Patent: Jul. 22, 2008

(54) EDGE SEWING APPARATUS

(75) Inventor: Yoshiyuki Sho, Kennesaw, GA (US)

(73) Assignee: YKK Corporation, Tokyo (JP)

( * ) Notice: Subject to any disclaimer, the term of this patent is extended or adjusted under 35 U.S.C. 154(b) by 146 days.

(21) Appl. No.: 11/482,457

(22) Filed: Jul. 7, 2006

(65) Prior Publication Data

US 2007/0017425 A1 Jan. 25, 2007

(30) Foreign Application Priority Data

Jul. 7, 2005 (JP) ..... P2005-199211

(51) Int. Cl.
*D05B 27/10* (2006.01)
*D05B 35/00* (2006.01)

(52) U.S. Cl. ..... 112/308; 112/153; 112/470.33

(58) Field of Classification Search ..... 112/303, 112/308, 309, 311, 318, 320, 470.01, 470.03, 112/470.16, 470.17, 152, 153, 470.33
See application file for complete search history.

(56) References Cited

U.S. PATENT DOCUMENTS 1,864,453 A * 6/1932 Lutz ..... 112/470.17
3,650,229 A * 3/1972 Rovin ..... 112/470.03
4,019,447 A * 4/1977 Blessing et al. ..... 112/470.01
4,593,636 A * 6/1986 Schips ..... 112/308
4,730,824 A * 3/1988 Huau et al. ..... 271/227
5,069,148 A 12/1991 Ishikawa et al.
5,161,474 A * 11/1992 Ishikawa et al. ..... 112/475.16
5,170,733 A 12/1992 Honma et al.
5,497,720 A * 3/1996 Kawasaki ..... 112/153
5,647,292 A * 7/1997 Morgulis et al. ..... 112/470.17
6,237,518 B1 * 5/2001 Yunoki et al. ..... 112/470.33

FOREIGN PATENT DOCUMENTS

DE 31 39 426 4/1983
JP 7-28970 4/1995

* cited by examiner

*Primary Examiner*—Ismael Izaguirre
(74) *Attorney, Agent, or Firm*—Alston & Bird LLP

(57) ABSTRACT

An edge sewing apparatus for carrying out edge sewing in a curved shape along one side edge of a cloth piece in a strip-like shape while rotating the cloth piece, which includes: a press rotating member rotated in accordance with feeding of the cloth piece while pressing the cloth piece; a rotational angle measuring device that measures a rotational angle of the press rotating member; and a press releasing device that releases the press rotating member from being pressed when the rotational angle measured by the rotational angle measuring device reaches a predetermined angle.

4 Claims, 7 Drawing Sheets

EDGE SEWING APPARATUS

BACKGROUND OF THE INVENTION

1. Field of the Invention

The present invention relates to an edge sewing apparatus for sewing an edge of a cloth piece in a strip-like shape along one side edge thereof in a curved shape.

2. Description of the Related Art

Conventionally, one corner portion of a cloth piece in a strip-like shape such as a fly of a jeans or an ordinary pants or the like is cut in a circular arc shape and edge sewing is carried out along a circular arc edge portion. In this edge sewing, normally, a sewing operator sews the edge while manually rotating the strip-like cloth piece centering on one end portion thereof, without using an exclusive sewing machine. However, according to the manual operation of rotating the strip-like shape cloth piece, by a difference in the technique among the sewing operators, not only an influence is effected on a production amount but also a difference is liable to be brought about in quality thereof.

In order to avoid the difference, there has been developed an edge sewing apparatus of carrying out edge sewing in a circular arc shape by rotating a cloth piece by utilizing a cloth feeding mechanism of a sewing machine by pressing one point of the cloth piece by moving a cylinder up and down and thereafter continuing the edge sewing in a linear shape. Such an edge sewing apparatus is disclosed in, for example, JP-B-7-28970. A strip-like cloth piece is fed skewedly to a cutting blade arranged at the edge sewing apparatus. When sewing is started under this state, the cloth piece is fed forward along a cloth feeding direction by a cloth feeding mechanism of an edge sewing portion while cutting a cloth end by the cutting blade. When the cloth piece is fed forward in this way, the cylinder is operated and one corner portion of a front side of the cloth piece is pressed by a ball. Therefore, the cloth piece is rotated centering on the ball by the cloth feeding mechanism for feeding the cloth piece in one direction. In accordance with the rotation, the one corner portion of the cloth piece is cut in a circular arc shape by the cloth cutting blade. Thereafter, edge sewing is carried out along the circular arc shape edge portion.

Further, according to the technique disclosed in JP-B-7-28970, in starting to rotate the one corner portion of the cloth piece, when a side end face on one side of the cloth piece is deviated from a cloth side end detecting sensor, a signal is generated from the cloth side end detecting sensor. The cylinder is then operated by the signal and the ball presses an upper face of the one corner portion of the cloth piece. When pressing by the ball is operated, by cloth feeding by the cloth feeding mechanism, the cloth piece is rotated centering on the pressing point of the ball. Then, the cloth piece is moved in a direction of making the side end face on one side of the cloth piece deviated from the cloth side end detecting sensor to be proximate to the cloth side end detecting sensor. When the side end face on one side of the cloth piece covers the cloth side end detecting sensor, operation of the cylinder is released by a detecting signal thereof to separate the ball upward from the upper face of the cloth piece. When edge sewing in the circular arc shape is carried out by a predetermined amount in this way, the cloth piece is guided on a linear line along a side end of the cloth piece to carry out edge sewing of a linearly sewing portion. That is, according to the edge sewing apparatus, the cloth piece is pressed by the point, the cloth piece is rotated centering on the point, the end portion of the cloth piece is detected by the detector and it is detected whether the cloth piece is rotated to a predetermined position.

SUMMARY OF THE INVENTION

Meanwhile, according to the edge sewing apparatus disclosed in JP-B-7-28970, the cloth feeding by bringing the cloth feeding mechanism and the cloth piece into contact with each other is converted into the rotation of the cloth piece. Therefore, there is a case where the point (the center) of rotating the cloth piece is deviated by a frictional resistance between the cloth feeding mechanism and the cloth piece. In this case, in forming a corner portion in a circular arc shape by cutting a portion of the cloth piece, a radius of the corner portion is changed and it is difficult to stably produce the cloth piece having a predetermined shape.

Further, when a size of the cloth piece is changed, a position of the detector for detecting the end portion of the rotated cloth piece needs to be reset. Thus, time and labor is required for the setting operation. Also, when a thickness of the cloth piece is changed, the press force of the ball needs to be changed and therefore, the cylinder position is obliged to be changed.

It is an object of the invention to provide an edge sewing apparatus for cutting one corner portion of a cloth piece in a strip-like shape in a circular arc shape and carrying out edge sewing in the circular arc shape along the cut edge, in which an edge sewing shape of the corner portion is not varied and even when a size or a thickness of the cloth piece is changed, the cloth piece can stably be produced always in a desired shape.

According to an aspect of the invention, there is provided an edge sewing apparatus for carrying out edge sewing in a curved shape along one side edge of a cloth piece in a strip-like shape while rotating the cloth piece, including: a press rotating member rotated in accordance with feeding of the cloth piece while pressing the cloth piece; a rotational angle measuring device that measures a rotational angle of the press rotating member; and a press releasing device that releases the press rotating member from being pressed when the rotational angle measured by the rotational angle measuring device reaches a predetermined angle.

It is preferable that the press rotating member is substantially in a shape of a circular plate, and a press face is constituted by a structure of biting a surface of the cloth piece. The biting structure of the press face can be formed by needle-like pin members dispersed to be projected over an entire face of the press face, or constituted by recessed and projected faces in a zigzag shape aligned over the entire face of the press face. However, the structure is not limited to the needle-like pin member or the recessed and projected face but, for example, there is a rib-like projected portion or the like extended radially from a center portion of the press rotating member.

According to the invention, the press face of the press rotating member, which is also a rotating member in sewing, presses the cloth piece onto a table by face contact. Linear edge sewing of the cloth piece is restrained by a press force by the press rotating member. On the other hand, since the press rotating member is freely rotated by fixing a rotational center thereof, the cloth piece per se is obliged to be rotated and the press rotating member is rotated in accordance with rotation of the cloth piece. Therefore, when the cloth piece is rotated, a center of rotation thereof is not deviated. Further, the rotational angle of the press rotating member is measured by the rotational angle measuring device and when the predetermined angle is confirmed to be reached, the press rotating member is released from being pressed. Therefore, the cloth piece can firmly be rotated to the previously set predetermined angle and the cloth piece can be finished by a predetermined shape.

If the press face is formed by a face having a large friction coefficient, the cloth piece can be rotated. When the friction face is simply formed, it is possible that the friction face wears over a long period of time. When, for example, a structure in which a portion of the press face bites the cloth piece is adopted, even when a size or a thickness of the cloth piece is changed, by only changing a position of guiding the cloth piece, the biting structure absorbs a variation in the thickness of the cloth piece. Thus, the press face can firmly grab the cloth piece by the face, and the press rotating member can firmly be rotated over a long period of time by following the cloth piece. As a preferable example of the biting structure, as described above, a plurality of needle-like pins may projected, or a recessed and projected face in a zigzag shape may be formed.

DETAILED DESCRIPTION OF THE PREFERRED EMBODIMENTS

An embodiment of the invention will be described with reference to the attached drawings.

Figure 1:
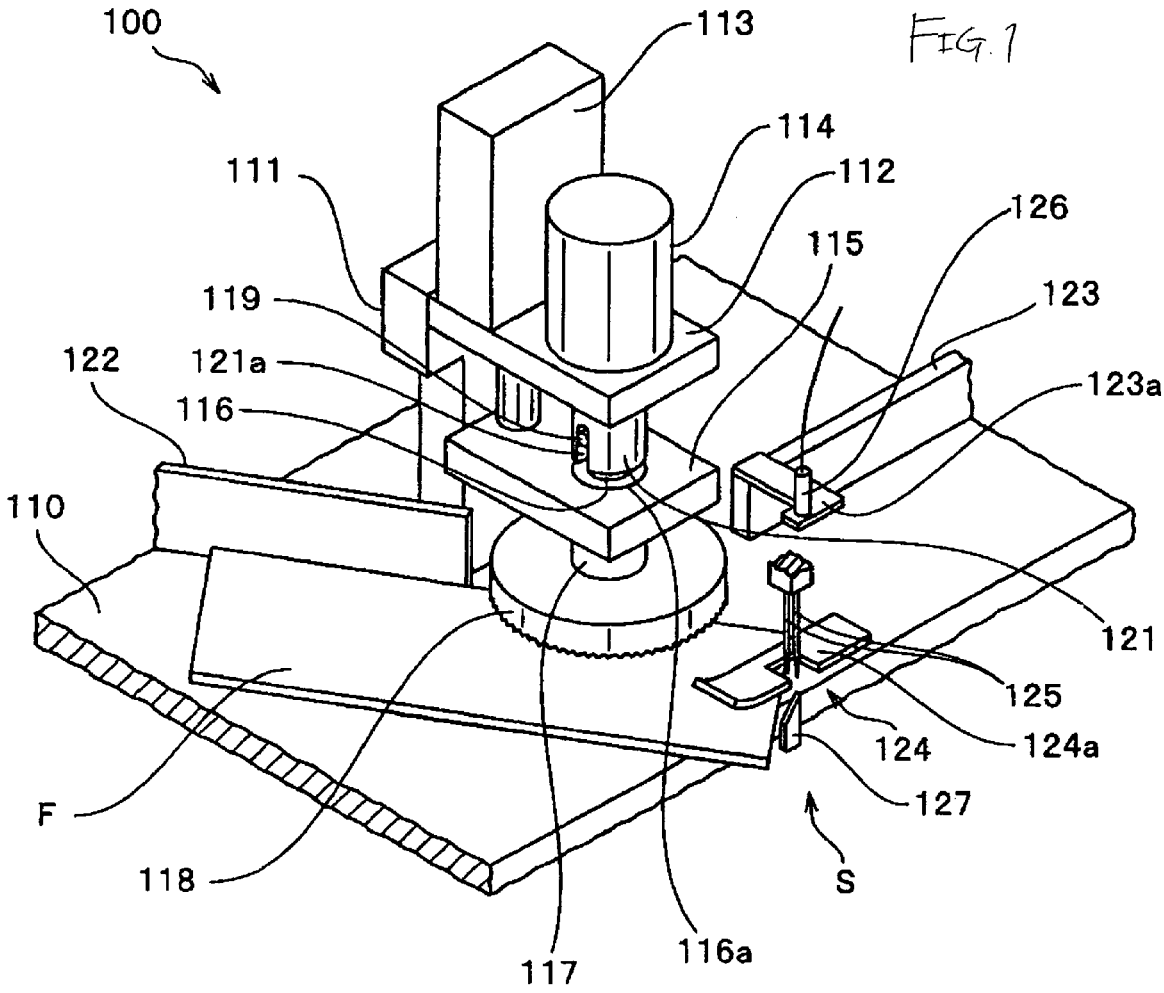
FIG. 1 is a perspective view showing an edge sewing apparatus according to an embodiment of the invention.
Figure 2:
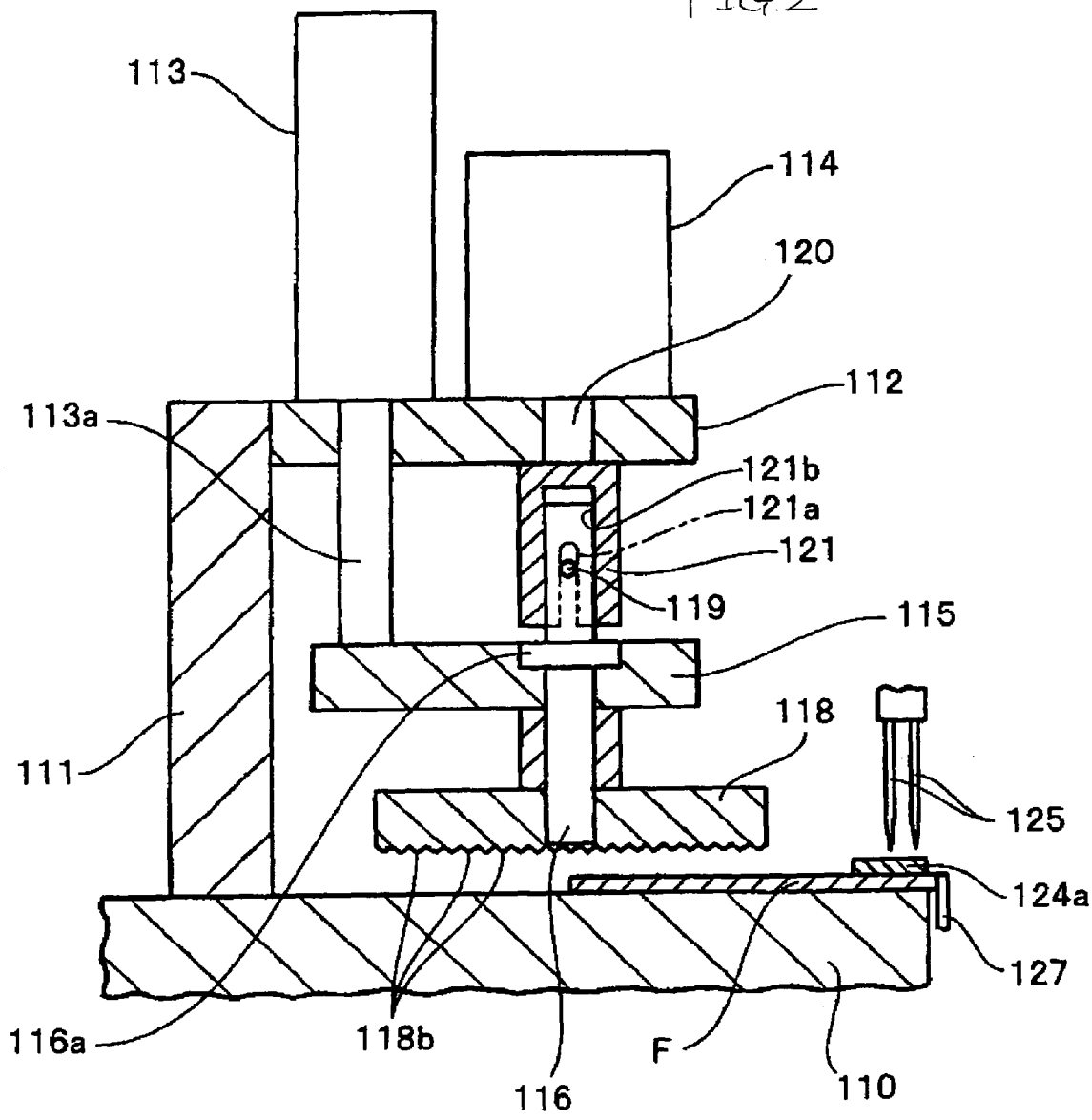
FIG. 2 is a sectional view of the apparatus.
Figure 3:
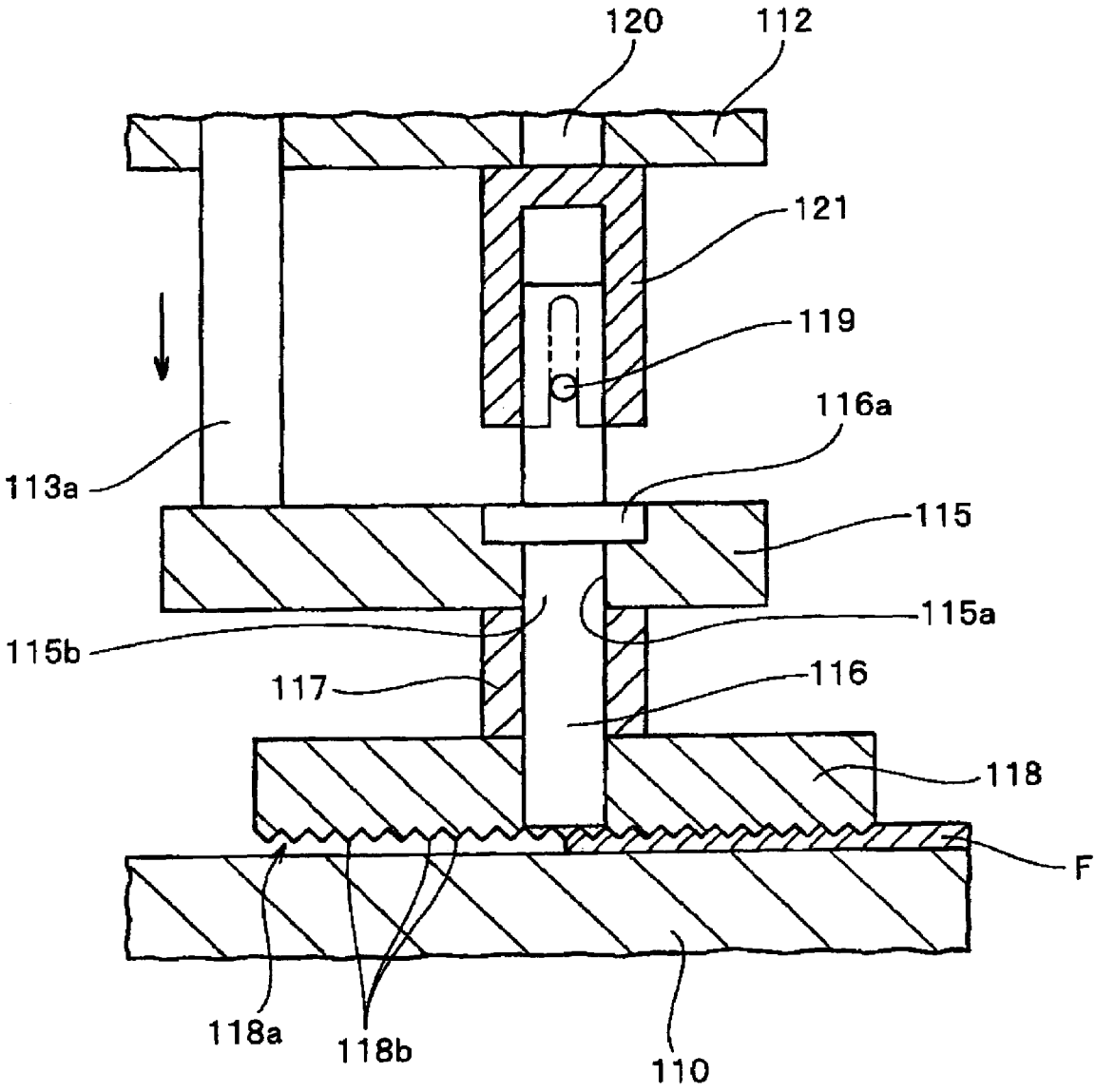
FIG. 3 is an enlarged sectional view showing a portion of FIG. 2 for explaining a state of pressing by a press rotating member.

FIG. 1 through FIG. 3 show an overview configuration of an edge sewing apparatus for a cloth piece in a strip-like shape according to the embodiment. FIG. 1 is a perspective view viewing the edge sewing apparatus from a skewed upper side, FIG. 2 is a sectional view of the edge sewing apparatus, and FIG. 3 is an enlarged sectional view showing a portion of FIG. 2. Incidentally, the edge sewing apparatus according to this embodiment is not completely automated but a semiautomated edge sewing apparatus, in which manual operation is partially needed. However, the edge sewing apparatus according to the invention is also applicable to a completely automated apparatus.

An edge sewing apparatus 100 of a strip-like cloth piece F according to the embodiment includes a table 110; a frame 111 erected on the table 110; a bracket 112 extended from an upper end of the frame 111 in one direction in parallel with an upper face of the table 110; a cylinder 113 and a rotational angle measuring device 114 disposed on an upper face of the bracket 112; an up and down moving member 115 in a plate-like shape fixed to a rod end of the cylinder 113 penetrating the bracket 112 and extractable and retractable in an up and down direction; a first rotating shaft 116 penetrating through the up and down moving member 115 and rotatably supported by the up and down moving member 115; a press rotating member 118 in a shape of a circular disk fixed to a lower end of the first rotating shaft 116 by way of a collar 117; a pin 119 extended horizontally while tip ends thereof being projected outward from a diameter of an upper end portion of the first rotating shaft 116; a second rotating shaft 120 provided to move cooperatively with a measuring portion of the rotational angle measuring device 114 and rotatably penetrating the bracket to be supported by the bracket 112; and a rotating shaft supporting member 121 connected to a lower end of the second rotating shaft 120.

The rotational angle measuring device 114 is constituted by a rotary encoder. A rotational angle is measured by generating a pulse from a change in a voltage of a photoelectric element or a change in a resistance of a magnetoresistive element in accordance with rotation of a rotating member provided on the second rotating shaft 120 and by counting the pulse. The rotating member is in a shape of, for example, a gear.

A flange portion 116*a* in a ring-like shape is expanded from a middle portion of the first rotating shaft 116. The up and down moving member 115 is formed with a through hole 115*a* loosely inserted with the first rotating shaft 116 at a center portion thereof. At a surrounding of the through hole 115*a*, a recessed portion 115*b* in a ring-like shape for fitting the flange portion 116*a* is formed. When the first rotating shaft 116 is loosely inserted into the through hole 115*a* of the up and down moving member 115 and the flange portion 116*a* is fitted to the recessed portion 115*b*. Since the collar 117 is interposed between the press rotating member 118 and the up and down moving member 115, the first rotating shaft 116 is made to be unmovable in the up and down direction although is rotatable relative to the up and down moving member 115. When the up and down moving member 115 is moved up and down, the first rotating shaft 116 is moved up and down along therewith.

The rotating shaft supporting member 121 shows a shape of an upside down bottomed cylinder. An upper end portion of the first rotating shaft 116 is contained at inside of an inner space 121*b* of the supporting member 121. Further, the pin 119 of the first rotating shaft 116 is loosely fitted to a slit-like notch 121*a* extending in the up and down direction at a side face of the rotating shaft supporting member 121 to thereby transmit rotation of the first rotating shaft 116 to the second rotating shaft 120. The first rotating shaft 116 is moved up and down along with the pin 119 guided by the slit-like notch 121*a* in accordance with movement of the up and down moving member 115 moving up and down by operating the cylinder 113.

An upper face of the table 110 is provided with a first cloth piece guide plate 122 on a feeding side and a second cloth piece guide plate 123 on a discharging side, which are erected while directing respective one ends thereof to a rotational center of the press rotating member 118. The second cloth piece guide plate 123 is arranged in parallel with a cloth feeding direction of a cloth feeding mechanism 124. The first cloth piece guide plate 122 on one side is arranged skewedly to the second cloth piece guide plate 123 such that respective extended faces of the first cloth piece guide plate 122 and the second cloth piece guide plate 123 are intersected to each other by a predetermined angle at the rotational center of the press rotating member 118. In this embodiment, the first and second cloth piece guide plates 122, 123 are fixedly provided on the table 110. When, for example, the table 110 is formed with a long hole (not shown) prolonged in a direction orthogonal to a direction of extending the first cloth piece guide plate 122, and a bolt inserting hole is formed at a fixing portion (not shown) of the first cloth piece guide plate 122, a change in a cloth width of the cloth piece F can easily be dealt with by adjusting the position.

Figure 6:
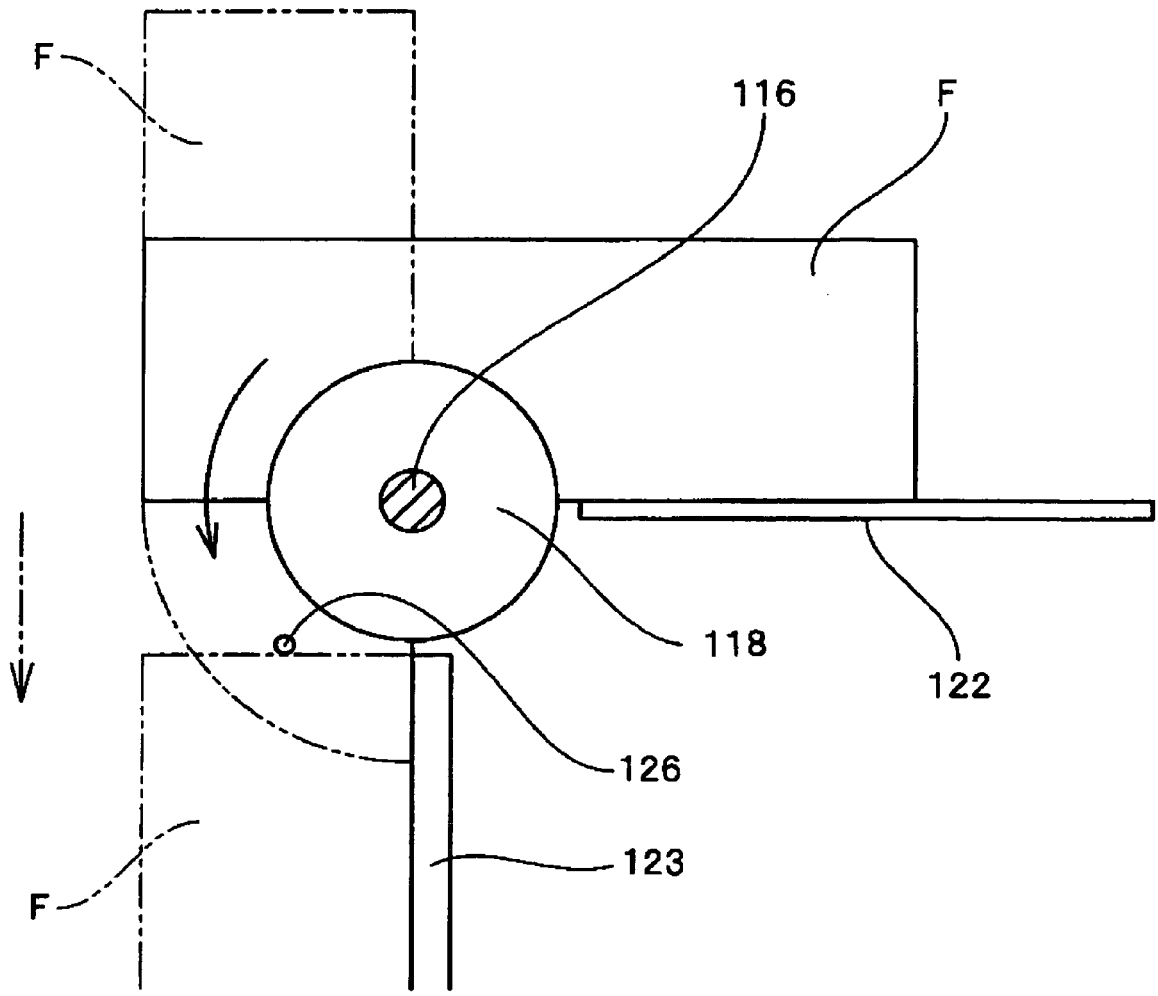
FIG. 6 is a plane view showing an outline of a modified example in feeding the cloth piece in the strip-like shape to the edge sewing apparatus.

In this embodiment, the first cloth piece guide plate 122 is skewedly arranged to feed the cloth piece F to an edge sewing portion S by an angle of 60° relative to a cloth feeding direction by the cloth feeding mechanism 124. The angle of inclination can arbitrarily be determined. For example, as shown in FIG. 6, the first cloth piece guide plate 122 can be arranged orthogonally to a linear edge sewing direction to feed the cloth piece F orthogonally.

The edge sewing portion S includes a looper, a cloth feeding teeth and the like (not shown) in addition to two pieces of needles 125 and a sewing machine foot 124*a* shown in FIG. 1. The sewing machine foot 124*a* is one of constituent members of the cloth feeding mechanism 124. Further, a cloth teeth detector 126 for detecting a rear end of the cloth piece F is supported and fixed by a supporting member 123*a* extended horizontally from an end portion on the side of the press rotating member of the second cloth piece guide plate 123. Further, a cutting blade 127 for cutting the one corner portion of the cloth piece F in the circular arc shape is arranged at a vicinity of an end face of the table 110 and on an obliquely lower side of the needles 125.

In the above-described configuration, an operator brings one side edge of the cloth piece F in the strip-like shape into contact with the first cloth piece guide plate 122 and one end of the cloth piece F as shown in FIG. 1 is set to an edge sewing position of the edge sewing portion S on the table 110. At this occasion, as shown in FIG. 2, the cylinder rod 113*a* is brought into a retracted state and therefore, the press rotating member 118, which is moved rotatably relative to the up and down moving member 115 fixed to the lower end of the rod 113*a* and integrally moved with the up and down moving member 115 in the up and down direction, is separated above from the cloth piece F. When the press rotating member 118 is brought into the separated state, the pin 119 projected horizontally from the upper end portion of the first rotating shaft 116 is loosely fitted to the pair of slit-like notches 121*a* formed at the rotating shaft supporting member 121 in the shape of the upside down bottomed cylinder.

When the cloth piece F has been f set, the operator operates the cylinder 113 in the extending direction by depressing a foot switch (not shown). By operating the cylinder 113, the cylinder rod 113*a* is extracted as shown in FIG. 3, and the press rotating member 118 is moved down by way of the up and down moving member 115 and presses a press face 118*a* onto the table to bite a predetermined region of the cloth piece F. The press face 118*a* is formed with a friction face such that the pressed cloth piece F is not slipped relative to the rotating member when rotated by the press rotating member. Specifically, the press face is aligned with a plurality of rib-like projected portions 118*b* in a zigzag shape, and the press face 118*a* is formed into a recessed and projected face by the projected portions 118*b* to bite a surface of the cloth piece F. Also, the pin 119 projected horizontally from the upper end portion of the first rotating shaft 116 is brought into state of being loosely fitted to the slit-like notch 121*a* formed at the rotating shaft supporting member 121 in the shape of the upside down bottomed cylinder.

Figure 4:
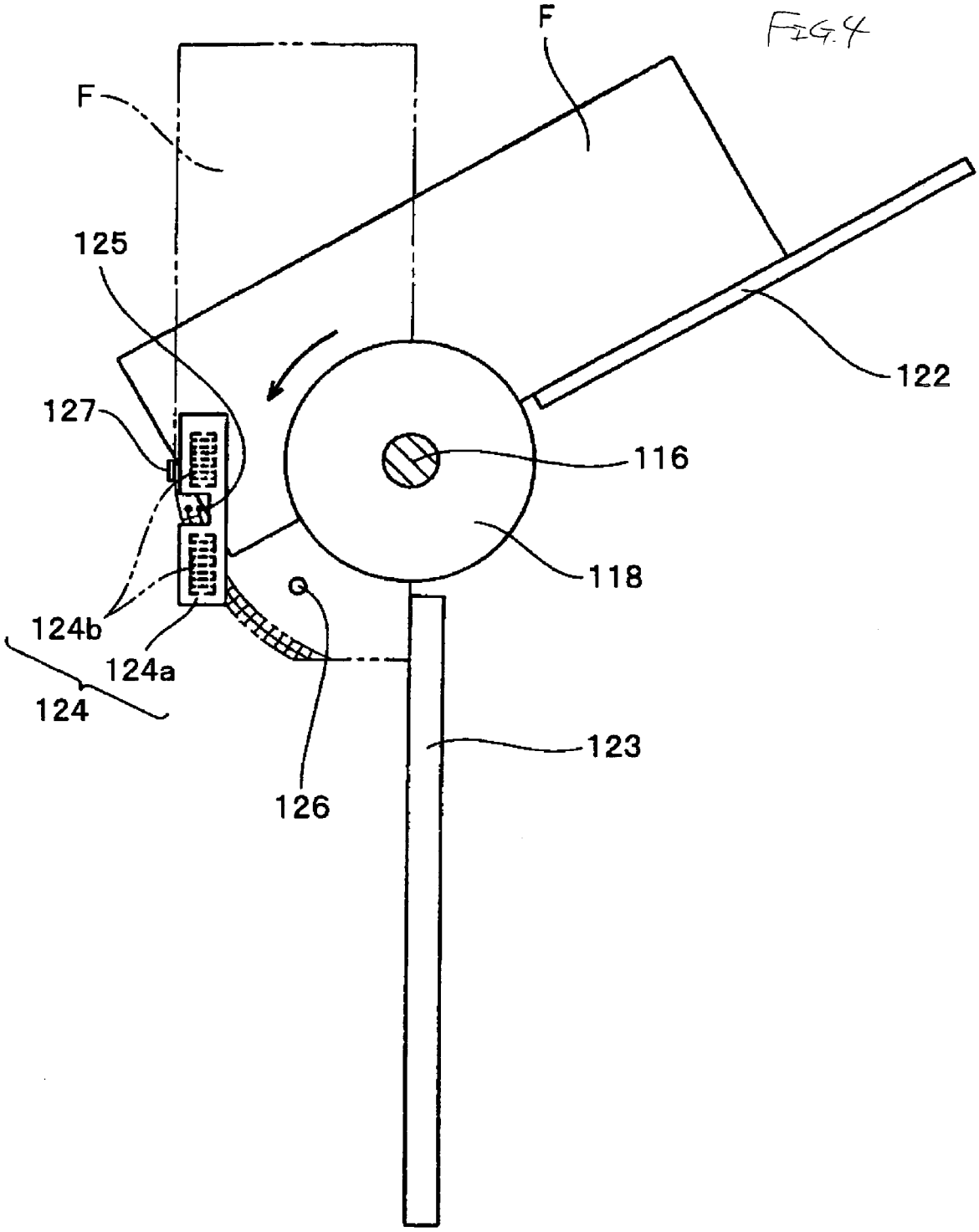
FIG. 4 is an explanatory view in edge sewing in a circular arc shape showing a behavior of cutting one corner portion and edge sewing in rotating a cloth piece in a strip-like shape.

When edge sewing is started, as shown in FIG. 4, the cloth piece F is going to be fed on a linear line by cloth feeding teeth 124*b*, since an inner side of one corner portion of the front end portion is pressed onto the table 110 in a biting state by a half portion of the press face 118*a* of the press rotating member 118. Therefore, the cloth piece F cannot advance on the linear line, but a total of the cloth piece F is rotated on the table 110 centering on the center of the press rotating member in the circular disk shape. At this occasion, the press rotating member 118 is rotated by rotation of the cloth piece F while maintaining the biting state since the press face 118*a* bites the cloth piece F. In accordance with rotation of the cloth piece F, while cutting a corner portion on a diagonal line side of the rotational center of the cloth piece F by the cutting blade 127 in a circular arc shape, sewing is carried out along an edge portion in the circular arc shape.

In rotation of the cloth piece F at this occasion, since the position of supporting the first rotating shaft 116 of the press rotating member 118 is unmovable and the press rotating member 118 is in the shape of circular disk having a predetermined diameter, a predetermined region of the cloth piece F is pressed with a predetermined area by a semicircular portion of the press rotating member 118. Thus, the rotational center of the cloth piece F is not varied, and at the same time, the rotation is performed while being pressed by the press rotating member 118 with the above-described area, thereby, the rotation is carried out firmly. When the cloth piece F is relatively rigid, it is not necessary to assist/hold the cloth piece F by the operator. When the cloth piece F is soft or is formed of thin cloth, the operator only prevents the cloth piece F when being rotated from being deformed by putting the hand at an end portion of the cloth piece F on a side being remote from the rotational center, thereby, the cloth piece is rotated smoothly.

When the cloth piece F is started to be rotated as described above, the press rotating member 118 is rotated together. This rotation of the press rotating member 118 rotates the first rotating shaft 116 and the second rotating shaft 120 simultaneously. Here, the pin 119 provided to the first rotating shaft 116 is loosely fitted to the slit 121*a* formed at the rotating shaft supporting member 121 and the pin 119 transmits the rotational force of the first rotating shaft 116 to the second rotating shaft 120 by way of the rotating shaft supporting member 121. Thereby, the first rotating shaft 116 and the second rotating shaft 120 are rotated simultaneously in the same direction. A rotational angle of the second rotating shaft 120, that is, a rotational angle of the cloth piece F is measured by a measuring portion (not shown) of the rotational angle measuring device 114.

At this occasion, the rotational angle measuring device 114 is previously set with a rotational angle, when the second rotating shaft 120 is rotated by the set rotational angle, an operating signal is generated from the rotational angle measuring device 114 to the cylinder 113. The set rotational angle is an angle when the side edge along a longitudinal direction of the cloth piece F is brought into contact with the second cloth piece guide plate 123 on the discharging side as shown by an imaginary line in FIG. 4. When the operating signal of the cylinder 113 is generated from the rotational angle measuring device 114, the cylinder 113 is operated in the retracting direction, and the press rotating member 118 is separated from the cloth piece F to bring about a state shown in FIG. 2.

Figure 5:
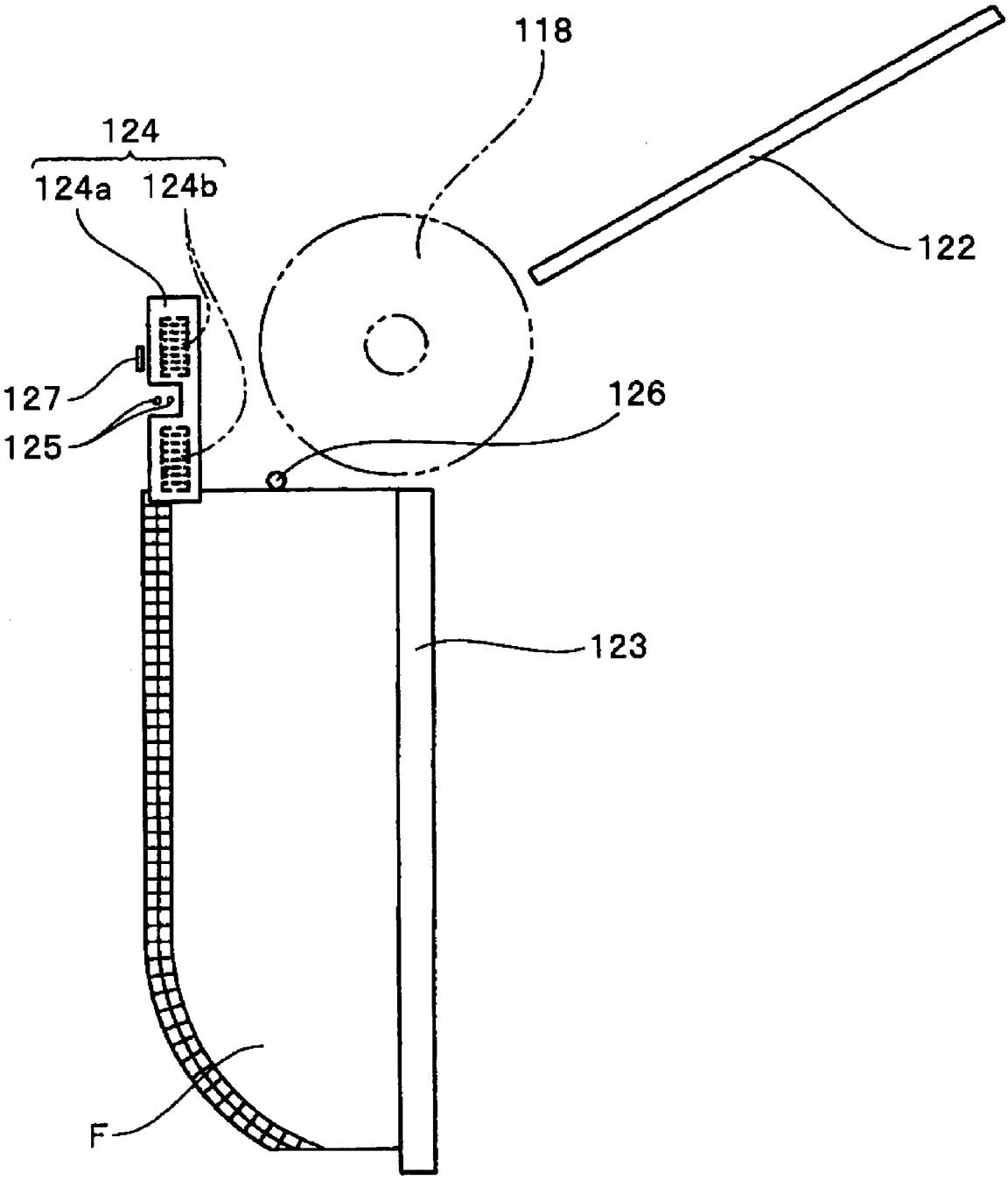
FIG. 5 is an explanatory view showing a behavior of finishing edge sewing in a linear shape after edge sewing in a circular arc shape.

Even when the press rotating member 118 is separated from the cloth piece F, edge sewing is progressed, and also after releasing the cloth piece F from being pressed by the press rotating member 118, edge sewing in a linear shape is progressed by guiding the cloth piece F while being brought into contact with the second cloth piece guide plate 123. Although the cloth piece detector 126 does not detect the cloth piece F at an initial stage of starting the edge sewing in the circular arc shape, a nondetecting signal is not particularly generated from the cloth piece detector 126 when the cloth piece F is not detected immediately after starting the edge sewing apparatus 100. In this case, when the cloth piece F continues to rotate further to reach a predetermined rotational angle, the cloth piece F passes the cloth piece detector 126 and a detecting signal is outputted from the cloth piece detector 126. The detecting signal is continued to be outputted from the cloth piece detector 126 also during a time period of edge sewing in the linear shape. Thereafter, as shown in FIG. 5, when an end edge of the cloth piece F on a side opposite to the side of edge sewing of the cloth piece F in the circular arc shape passes the cloth piece detector 126, a passing signal thereof is outputted to a drive portion and a portion of discharging the cloth piece after finishing edge sewing (not shown) of the edge sewing apparatus 100. Thus, simultaneously with stopping to drive the edge sewing apparatus 100, the cloth piece finished with edge sewing is carried to outside of the apparatus by driving, for example, a carrying belt (not shown).

Figure 7:
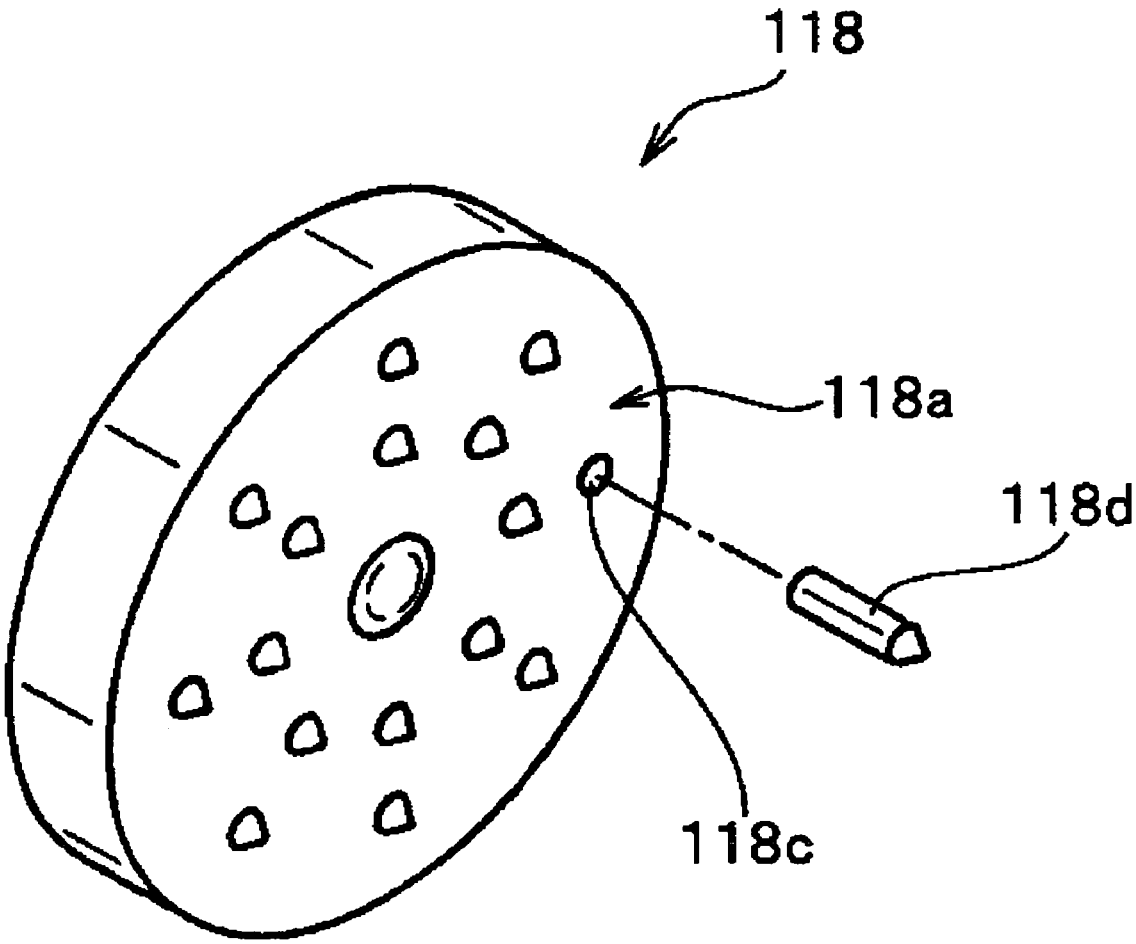
FIG. 7 is a partially exploded perspective view viewed from a press face and showing a modified example of the press rotating member.

FIG. 7 shows a modified example of the press rotating member 118. The press rotating member 118 is in a shape of a circular disk similar to the press rotating member 118 in the above-described embodiment. However, a structure of the press face 118*a* for biting the cloth piece is not constituted by a plurality of rows of projected portions in a zigzag shape as in the above-described embodiment but is constituted by a flat face formed with a plurality of pin holes 118*c* on concentric circles of the flat face by a predetermined pitch. Pin members 118*d* capable of being fixedly inserted into the pin holes 118*c* by being closely fitted thereto or by way of an adhesive is closely fitted or inserted into the pin hole 118*c* while leaving a front end thereof. The front end projected portion of the pin member 118*d* is in a conical shape. Further, the structure of the press face 118*a* of the press rotating member 118 for biting the cloth piece is not limited to the projected portion in the zigzag shape according to the embodiment or the projected portion by the pin member. For example, a rib-like projected portion in a linear shape extended radially from a center portion on the press face 118*a* can also be formed and a variety of modified examples can be adopted.

What is claimed is:

1. An edge sewing apparatus for carrying out edge sewing in a curved shape along one side edge of a cloth piece in a strip-like shape while rotating the cloth piece, comprising:

a press rotating member being freely rotatable and rotated in accordance with feeding of the cloth piece while pressing the cloth piece;

a rotational angle measuring device that measures a rotational angle of the press rotating member; and a press releasing device that releases the press rotating member from being pressed when the rotational angle measured by the rotational angle measuring device reaches a predetermined angle.

2. The edge sewing apparatus according to claim 1, wherein the press rotating member substantially has a shape of a circular plate, and a press face is constituted by a structure of biting a surface of the cloth piece.

3. The edge sewing apparatus according to claim 1, wherein the press rotating member substantially has a shape of a circular plate, and a press face is formed with a plurality of projected portions.

4. The edge sewing apparatus according to claim 1, wherein the press rotating member substantially has a shape of a circular plate, and a press face is formed into a recessed and projected face.

* * * * *